US009462858B2

(12) United States Patent
Levinson et al.

(10) Patent No.: US 9,462,858 B2
(45) Date of Patent: Oct. 11, 2016

(54) LEFT AND RIGHT EARRING SUPPORT BACKINGS

(71) Applicants: Robin A. Levinson, Fort Lauderdale, FL (US); Ruben Derlly, Fort Lauderdale, FL (US)

(72) Inventors: Robin A. Levinson, Fort Lauderdale, FL (US); Ruben Derlly, Fort Lauderdale, FL (US)

(73) Assignee: Earring Support, LLC, Fort Lauderdale, FL (US)

( * ) Notice: Subject to any disclaimer, the term of this patent is extended or adjusted under 35 U.S.C. 154(b) by 0 days.

(21) Appl. No.: 14/547,312

(22) Filed: Nov. 19, 2014

(65) Prior Publication Data

US 2015/0135495 A1 May 21, 2015

Related U.S. Application Data

(63) Continuation of application No. 14/169,080, filed on Jan. 30, 2014, now Pat. No. 9,198,486, which is a continuation of application No. 29/473,110, filed on Nov. 19, 2013, now Pat. No. Des. 727,778.

(60) Provisional application No. 61/976,534, filed on Apr. 8, 2014.

(51) Int. Cl.
*A44C 7/00* (2006.01)

(52) U.S. Cl.
CPC ..... *A44C 7/003* (2013.01); *Y10T 24/41* (2015.01); *Y10T 24/45262* (2015.01)

(58) Field of Classification Search
None
See application file for complete search history.

(56) References Cited

U.S. PATENT DOCUMENTS

| | | | | |
|---|---|---|---|---|
| 2,009,537 A * | 7/1935 | Williams | ..... | A44C 7/00 63/14.2 |
| 2,931,196 A | 4/1960 | Liftman | | |
| 3,446,033 A | 5/1969 | Driscoll | | |
| 3,563,056 A | 2/1971 | Noel | | |
| 3,630,048 A | 12/1971 | Masters | | |
| 4,688,400 A | 8/1987 | Chioffe | | |
| 4,993,240 A * | 2/1991 | Pounder | ..... | A44C 7/009 63/12 |

(Continued)

FOREIGN PATENT DOCUMENTS

| | | |
|---|---|---|
| JP | 3284204 | 3/1990 |
| JP | 03-295503 | 12/1991 |

(Continued)

*Primary Examiner* — Jack W Lavinder
(74) *Attorney, Agent, or Firm* — The Concept Law Group, P.A.; Scott D. Smiley; Erin A. Martin

(57) ABSTRACT

A pair of earring supports for a pair of earrings having earring posts, the pair of earring supports including retainer plates. Each retainer plate respectfully has a post hole formed therein. A first face configured for engaging an ear. A second face opposite the first face. A fastening clip at the second face, the fastening clip is configured for engaging an earring post passing through the post hole, and a stabilizing support has an attachment point affixed at an attachment intersection on the retainer plate. The stabilizing support extends from the retainer plate to a free end of the stabilizing support spaced apart from the retainer plate. The free end of a first retainer plate of the retaining plates is counterclockwise from the first attachment intersection of the first retainer plate when viewing the first retainer plate in a direction towards the second face of the first retainer plate. The free end of a second retainer plate of the retaining plates is clockwise from the attachment intersection of the second retainer plate when viewing the second retainer plate in a direction towards the second face of the second retainer plate.

13 Claims, 20 Drawing Sheets

(56) References Cited

U.S. PATENT DOCUMENTS

| | | | |
|---|---|---|---|
| 5,588,309 | A | 12/1996 | Chioffe |
| 5,906,114 | A | 5/1999 | Rissin |
| D461,140 | S | 8/2002 | Benhamou |
| 6,718,796 | B2 | 4/2004 | Baum et al. |
| 7,818,852 | B2 | 10/2010 | Van der Greft |
| 2002/0124364 | A1 | 9/2002 | Rissin et al. |
| 2007/0163298 | A1 | 7/2007 | Van der Greft |
| 2011/0191991 | A1 | 8/2011 | Meneau |

FOREIGN PATENT DOCUMENTS

| | | |
|---|---|---|
| KR | 20-0391052 | 7/2005 |
| KR | 10-2010-00086450 | 1/2010 |
| KR | 10-0943245 | 2/2010 |

* cited by examiner

LEFT AND RIGHT EARRING SUPPORT BACKINGS

CROSS-REFERENCE TO RELATED APPLICATIONS

This application claims the benefit of U.S. Design patent application No. 29/473,110 filed Nov. 19, 2013, titled Curlycue Earring Support, U.S. Non-Provisional patent application Ser. No. 14/169,080 filed on Jan. 30, 2014, titled Left and Right Earring Support Backings and U.S. Provisional Application No. 61/976,534 filed on Apr. 8, 2014, titled Left and Right Earring Support Backings. The above-noted applications are incorporated herein by reference in their entirety.

FIELD OF THE INVENTION

The invention relates to earring support backings/backs for use with earrings. Earrings, as well known, are jewelry that are worn by a wearer on the wearer's ears. Typically, earrings are worn on the earlobe portion of the ear and are releasably attached to the earlobe. The jewelry portion of the earring is displayed on the front portion of the earlobe of the ear so that the jewelry portion faces forward to be seen on the wearer's ears. The earrings are releasably attached to the wearer's ear in a number of ways. One way to attach an earring is with a post which is fixedly attached to the jewelry. The post portion of the earring is threaded or inserted through an opening in the earlobe of the wearer's ear. A back or backing or retainer is then releasably attached to the earring post at the back portion of the earlobe to keep the earring and earring post attached to the earlobe of the ear. This prevents the earring post from sliding out of the opening in the earlobe, reducing the chance of a loss of the earring with its jewelry. The opening in the earlobe is normally created by a body piercing as is well known in the art.

DESCRIPTION OF THE RELATED ART

Earring support backings/backs also known as retainers for earrings are well known. Additionally the retainer can have a stabilizer that extends from the earring retainer to support the earring on the ear, preventing the earring from drooping or tilting in a forward or downward direction. The stabilizer portion of the retainer rests against the rear portion of the earlobe. However, earring support backings for earrings have not previously been designed for placement on the left ear and the right ear.

SUMMARY OF THE INVENTION

The present invention pertains to earring support backings for use with earrings where the earring support backings are distinguished from one another for placement on the left and right ears. One earring support backing is for placement to hold and support an earring on the left ear, and one earring support backing is for placement to hold and support an earring on the right ear. The earrings backings can be used as a pair at the same time, one to hold and support an earring on the left ear and one to hold and support an earring on the right ear. The earring backings can also be worn to support only a single earring on a wearer, for the respective right or left ear.

The earring support backings of the present invention can take numerous shapes and designs within the scope of the invention. The shape of the support backings include but are not limited to a left curlycue earring support and a right curlycue earring support attached to the earring backing. As used herein, the curlycue stabilizer can include a free end being at a position which is clockwise or counterclockwise from an attachment location. It is also possible for a second or additional points of the curlycue to be attached on the backing while maintaining the free end.

The back portions of a person's left and right ears are normally substantially mirror symmetrical to one another to one another. Similarly, the right earlobe and a left earlobe are mirror symmetrical to one another to one another. Prior to the present invention, earring backings did not take into account the left and right ears and/or earlobes and the differences of anatomical features and the differences between left and right that result from symmetry. The earring support backings of the present invention are individually constructed for respectively supporting an earring on a left ear and an earring on the right ear. In this manner, the earring support backing can provide better support of an earring on the right or left earlobe and provide improved support structure for supporting the earring on the left ear and/or the right ear.

With the foregoing and other objects in view there is provided, a pair of earring supports for a pair of earrings having earring posts, the pair of earring supports including retainer plates. Each retainer plate respectfully has a post hole formed therein. A first face configured for engaging an ear. A second face opposite the first face. A fastening clip at the second face, the fastening clip is configured for engaging an earring post passing through the post hole, and a stabilizing support has an attachment point affixed at an attachment intersection on the retainer plate. The stabilizing support extends from the retainer plate to a free end of the stabilizing support spaced apart from the retainer plate. The free end of a first retainer plate of the retaining plates is counterclockwise from the first attachment intersection of the first retainer plate when viewing the first retainer plate in a direction towards the second face of the first retainer plate. The free end of a second retainer plate of the retaining plates is clockwise from the attachment intersection of the second retainer plate when viewing the second retainer plate in a direction towards the second face of the second retainer plate.

In accordance with another feature of the invention, the stabilizer support defines a cantilever between the attachment point and the free end.

With the objects of the invention in view, there is also provided an earring support for an earring having an earring post, the earring support includes a retainer plate having a post hole formed therein. A first face is configured for engaging an ear, a second face opposite the first face. A fastening clip at the second face, the fastening clip is configured for engaging an earring post passing through the post hole. The retainer plate has a stabilizing support. The stabilizing support has an attachment point affixed at an attachment intersection on the retainer plate. The stabilizing support extends from the retainer plate to a free end of the stabilizing support spaced apart from the retainer plate. The free end is at a position which is one of clockwise or counterclockwise from the attachment intersection when viewing the retainer plate in a direction towards the second face of the retainer plate.

In accordance with an added feature of the invention, the stabilizing support is formed of wire.

In accordance with an additional feature of the invention, the retainer plate has a second stabilizing support. The second stabilizing support has a second attachment point affixed at a second attachment intersection on the retainer plate. The second stabilizing support extends from the retainer plate to a second free end of the second stabilizing support spaced apart from the retainer plate. The second free end is at a position which is one of clockwise or counterclockwise from the second attachment intersection when viewing the retainer plate in a direction towards the second face of the retainer plate.

With the foregoing and other objects in view there is provided an earring support for an earring having an earring post. The earring support includes a retainer plate that has a post hole formed therein, a first face configured for engaging an ear, a second face opposite the first face. The second face has a fastening clip configured for engaging an earring post passing through the post hole. The retainer plate has a stabilizing support. The stabilizing support has an end affixed at an attachment location on the retainer plate. The stabilizing support extends in a spiral from the retainer plate to a free end of the stabilizing support spaced apart from the retainer plate.

In accordance with yet another added feature of the invention, the free end is at a position which is one of clockwise or counterclockwise from the attachment location when viewing the retainer plate in a direction from the second face of the retainer plate.

In accordance with still another added feature of the invention, the first stabilizer support and the second stabilizer support are in contact.

In accordance with yet still another added feature of the invention, the first stabilizer support and the second stabilizer support are in contact at their respective free ends.

With the foregoing and other objects in view there is provided an earring support for an earring having an earring post. The earring support includes a retainer plate that has a post hole formed therein. A first face configured for engaging an ear, a second face opposite the first face. The second face has a fastening clip configured for engaging an earring post passing through the post hole. The retainer plate has a stabilizing support. The stabilizing support has an end affixed at an attachment location on the retainer plate. The stabilizing support extends in a spiral from the retainer plate to a free end of the stabilizing support spaced apart from the retainer plate.

In accordance with yet still another further feature of the invention, the free end is at a position which is one of clockwise or counterclockwise from said attachment location when viewing said retainer plate in a direction towards said second face of said retainer plate.

With the foregoing and other objects in view there is provided an earring support for an earring having an earring post. The earring support includes a retainer plate that has a post hole formed therein, a first face configured for engaging an ear, and a second face opposite the first face. The first face defines a plane substantially normal to the post hole. A fastening clip at the second face. The fastening clip is configured for engaging an earring post passing through the post hole. The retainer plate has a stabilizing support. The stabilizing support has an attachment end affixed at an attachment location on the retainer plate. The stabilizing support extends from the attachment location. The stabilizing support is asymmetrical when looking at the plane along the post hole. The above-noted asymmetry of the stabilizing support serves to individualize earring supports to the right or left ear. Specifically, as seen from FIGS. 17 and 19, the asymmetry allows the stabilizer support to generally follow the outer edge of the respective ear while providing clearance toward the proximal portion of the ear. This geometry/construction provides advantages over existing earring backings with respect to supporting large or heavy earrings. Wherein large and heavy earrings would be earrings which would distort a wearer's ear while being worn with traditional backings, such is easily recognizable to persons of skill in the art.

In accordance with still a further feature of the invention, the attachment end is an attachment point. The attachment location is an attachment intersection, and the stabilizer is a wire.

With the foregoing and other objects in view there is provided a pair of earring supports for a pair of earrings having earring posts. The pair of earring supports includes retainer plates. Each retainer plate respectfully has: a post hole formed therein; a first face configured for engaging an ear, the first face defines a plane substantially normal to the post hole; a second face opposite the first face; and a fastening clip at the second face, the fastening clip is configured for engaging an earring post passing through the post hole. A first retainer plate of the retaining plates has a first stabilizing support. The first stabilizing support has a first stabilizing support attachment end affixed at a first retainer plate attachment location on the first retainer plate. The first stabilizing support extends from the first retainer plate attachment location. The first stabilizing support is asymmetrical when looking at the plane of the first retainer plate along the post hole of the first retainer plate. A second retainer plate of the retaining plates has a second stabilizing support. The second stabilizing support has a second stabilizing support attachment end affixed at a second retainer plate attachment location on the second retainer plate. The second stabilizing support extends from the second retainer plate attachment location. The second stabilizing support is asymmetrical when looking at the plane of the second retainer plate along the post hole of the second retainer plate. The first stabilizing support is mirror symmetrical to the second stabilizing support when considered from a common prospective with respect to the first and second retainer plates.

In accordance with still another feature of the invention, the first and second stabilizers are wires.

DESCRIPTION OF THE PREFERRED EMBODIMENTS

Figure 2:
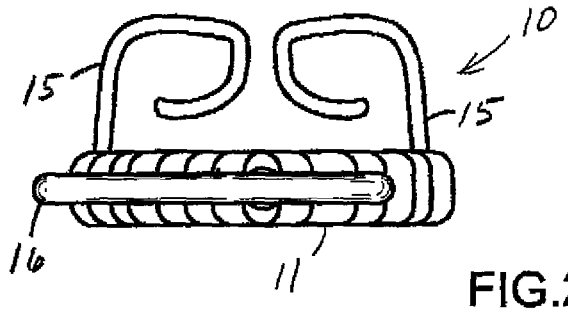
FIG. 2 is a top view of the right curlycue earring support of FIG. 1.

Earring support backings 10 and 30 include a right support backing 10 shown in FIGS. 1 to 7, the right support backing 10 has an earring plate, back, or retainer 11 with a post hole 12. Retainer 11 has a first face 13 and a second face 14 opposite the first face 13. The second face 14 has a fastening clip 15, as known in the art, for fastening the right support backing 10 to an earring 50 to be worn in a respective ear. The fastening clip 15 is configured for engaging an earring post 52 passing through said post hole 12. The fastening clip 15 may be an independent mechanical component of the retainer 11, not attached, or it may be affixed to the second face 14 of the retainer 11.

Figure 1:
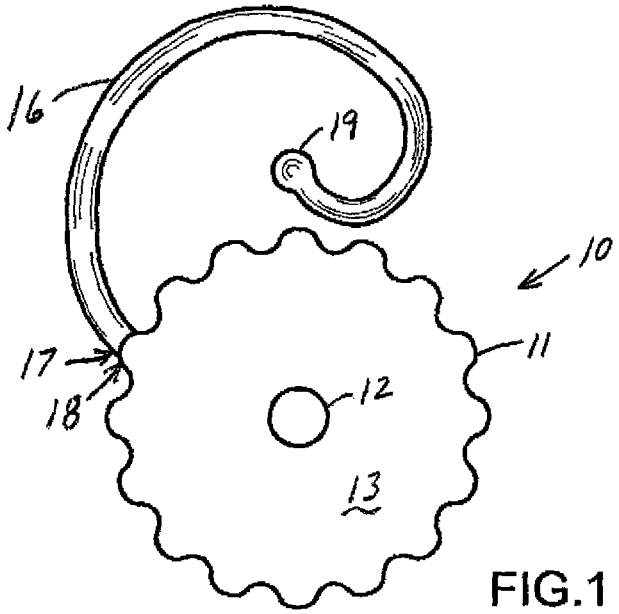
FIG. 1 is a front view of a right curlycue earring support for a right ear.
Figure 3:
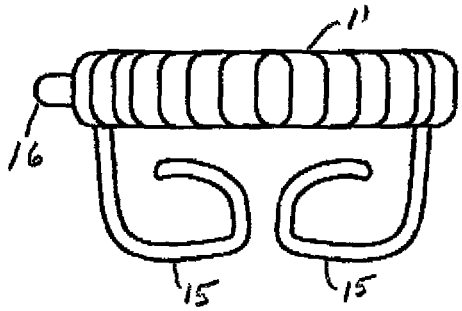
FIG. 3 is a bottom view of the right curlycue earring support of FIG. 1.
Figure 5:
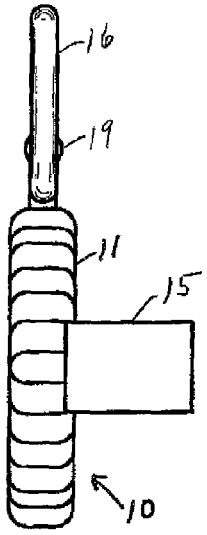
FIG. 5 is a side view of the right curlycue earring support of FIG. 1.
Figure 4:
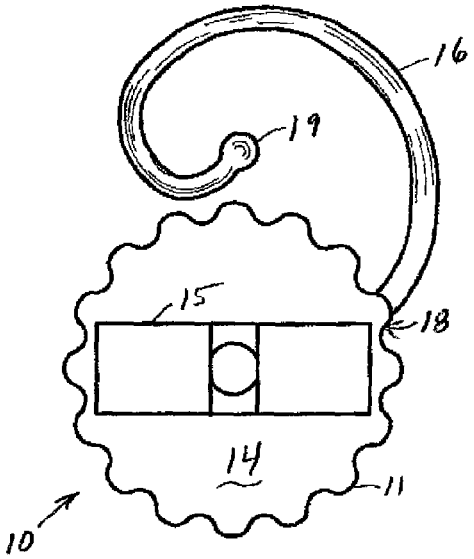
FIG. 4 is a rear view of the right curlycue earring support of FIG. 1.
Figure 6:
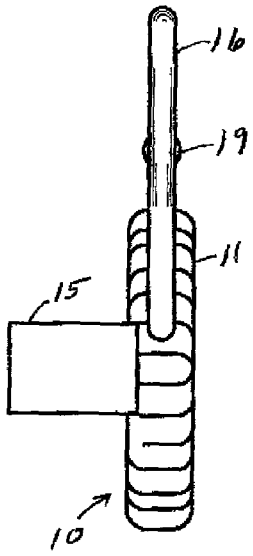
FIG. 6 is another side view of the right curlycue earring support of FIG. 1.
Figure 7:
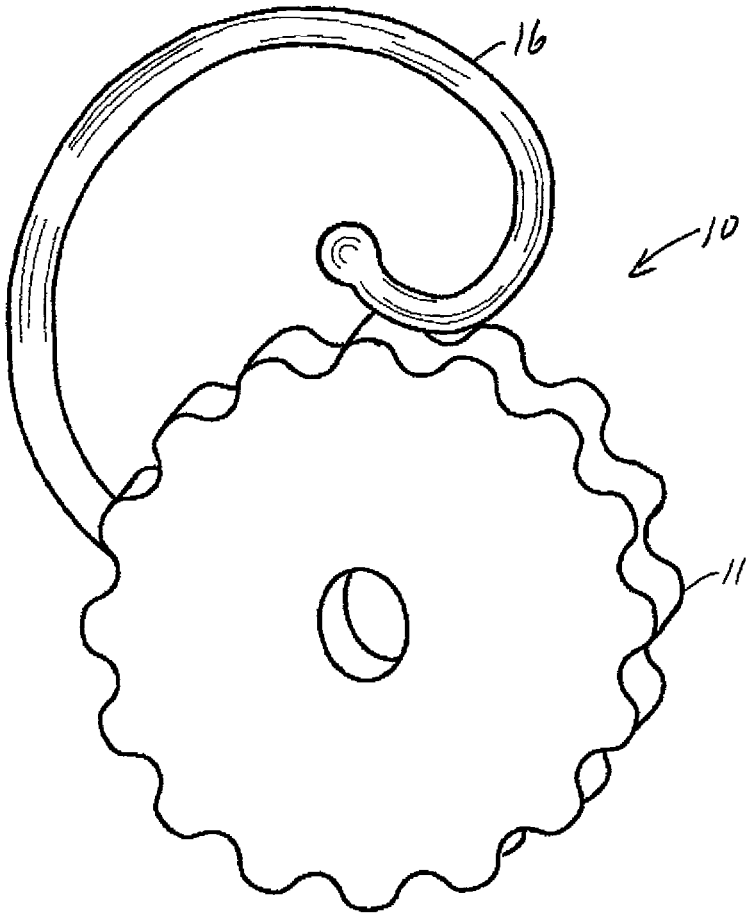
FIG. 7 is a front perspective view of the right curlycue earring support of FIG. 1.
Figure 9:
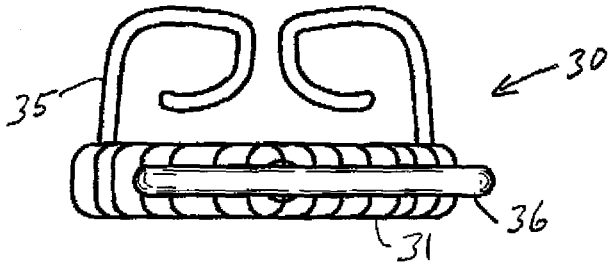
FIG. 9 is a top view of the left curlycue earring support of FIG. 8.

Earring retainer 11 has a stabilizer support 16 shown as a wire, the stabilizer support 16 having a first point 17 at an attachment location/intersection 18 on the retainer 11. The stabilizer support 16 extends from retainer 11 to a free end 19 of the stabilizer support 16 spaced apart from the retainer 11. As seen in FIG. 1, the free end 19 is at a terminus of a generally spiral path, clockwise from the attachment intersection 18, when viewing the retainer 11 in a direction towards the first face 13 of the retainer 11. As seen in FIG. 4, the free end 19 is counterclockwise from the attachment intersection 18 when viewing the retainer 11 in a direction towards the second face 14 of the retainer 11. The stabilizer support 16 may be attached to the retainer by solder at the attachment intersection 18, welding or other affixing means known in the art. The retainer 11, stabilizer support 16 and fastening clip 15 may be made of any materials used for earrings and earring backings including gold, silver and stainless steel as well as other suitable materials and metals. Further the retainer 11 and stabilizer support 16 may be stamped from a material and be a solid piece.

The pair of earring supports 10 and 30 includes a left support backing 30 shown in FIGS. 8 to 14, the left support backing 30 has a second earring retainer 31 with a post opening/hole 32. Retainer 31 has a first face 33 and a second face 34 opposite the first face 33. The second face 34 has a fastening clip 35, as known in the art, for fastening the left support backing 30 to an earring 40 to be worn in a respective ear. The fastening clip 35 is configured for engaging an earring post 42 passing through said post hole 32. The fastening clip 35 may be an independent mechanical component of the retainer 31, not attached, or it may be affixed to the second face 34 of the retainer 31.

Figure 8:
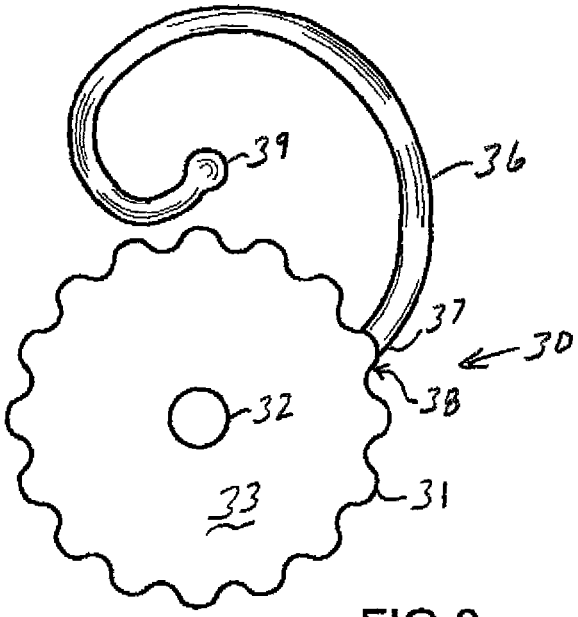
FIG. 8 is a front view of a left curlycue earring support for a left ear according to the embodiment of FIG. 1.
Figure 10:
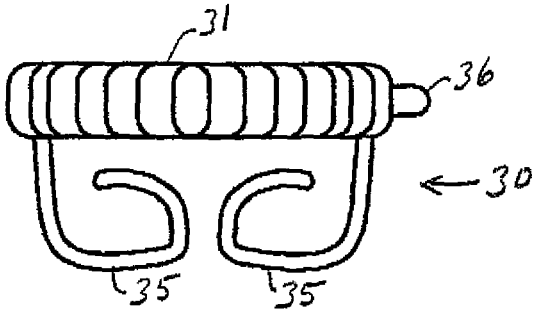
FIG. 10 is a bottom view of the left curlycue earring support of FIG. 8.
Figure 12:
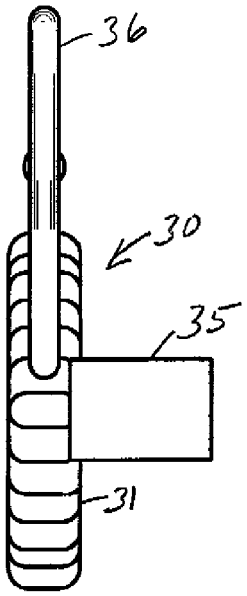
FIG. 12 is a right side view of the left curlycue earring support of FIG. 8.
Figure 11:
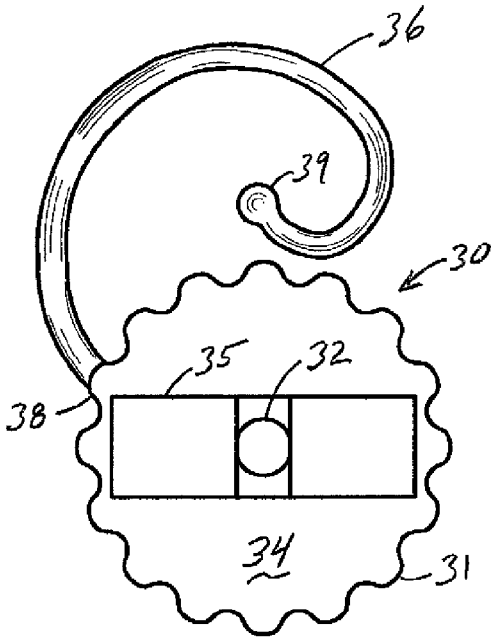
FIG. 11 is a rear view of the left curlycue earring support of FIG. 8.
Figure 13:
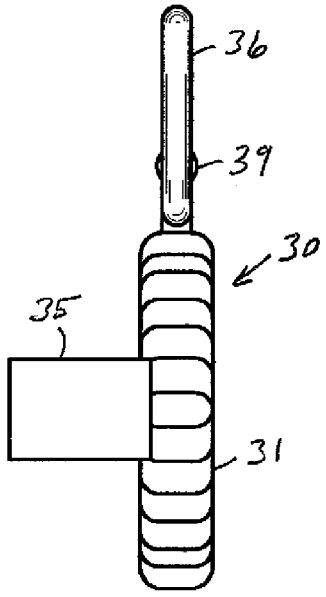
FIG. 13 is another side view of the left curlycue earring support of FIG. 8.
Figure 14:
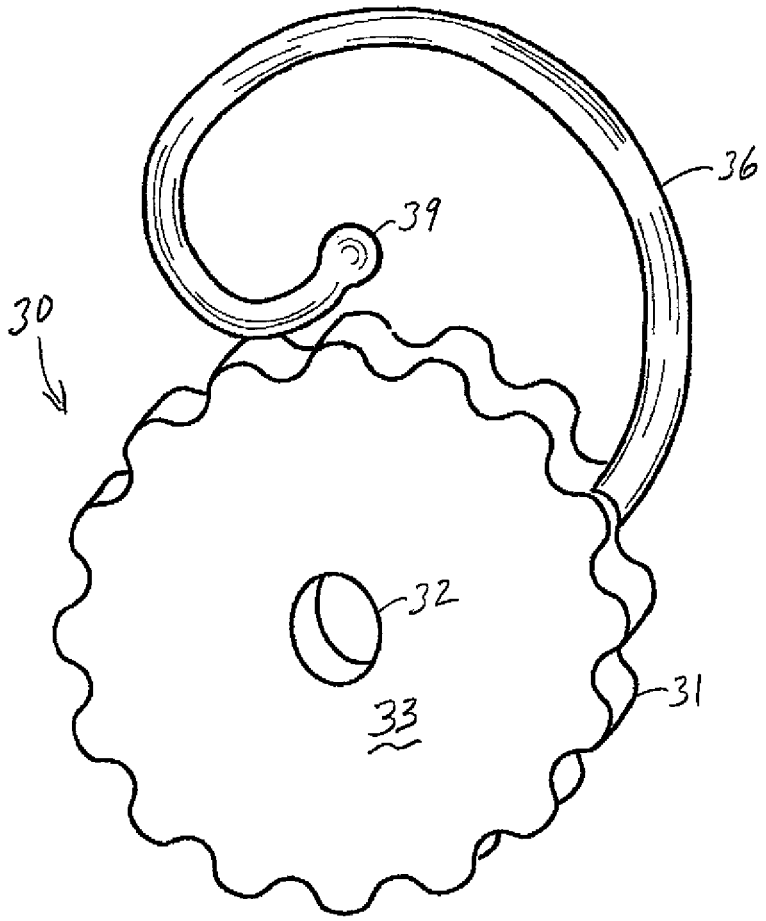
FIG. 14 is a front perspective view of the left curlycue earring support of FIG. 8.

Earring retainer 31 has a stabilizer support 36 having first point 37 at an attachment location/intersection 38 on retainer 31. The stabilizer support 36 extends from retainer 31 to a free end 39 of the stabilizer support 36 spaced apart from the second retainer 31. As seen in FIG. 8, the free end 39 is at the terminus of a generally spiral path counterclockwise from the attachment intersection 38 when viewing the retainer 31 in a direction towards the first face 33 of the retainer 31. The free end 39 is clockwise from the attachment intersection 38 when viewing the retainer 31 in a direction towards the second face 34 of the retainer 31 as shown in FIG. 11. The stabilizer support 36 may be attached at attachment intersection 38 to the retainer 31 by solder, welding or other affixing means. The retainer 31, stabilizer support 36 and fastening clip 35 may be made of any materials used for earrings and earring backings including gold, silver and stainless steel as well as other suitable materials and metals. Further the retainer 31 and stabilizer support 36 may be stamped from a material and be a solid piece.

As heretofore described, earring support backings 10 and 30 are generally symmetrical with respect to one another (left and right). However, the earring support backings 10 and 30 are individually asymmetrical. This means that when considering FIG. 1 for example, looking at the earring support backing 10, as shown on the page (along the post hole and in the direction towards the first face), the stabilizer support is asymmetrical, which makes the earring support backing 10 asymmetrical. It is this asymmetry of the individual earring support backings 10 and 30 which makes each of the earring support backings 10 and 30 individually conform to the anatomical features of the left and right ears.

As used herein this application, clockwise and counter clockwise is to be considered with the retainer plate defining the clock and the post hole as the center of the clock.

Figure 15:
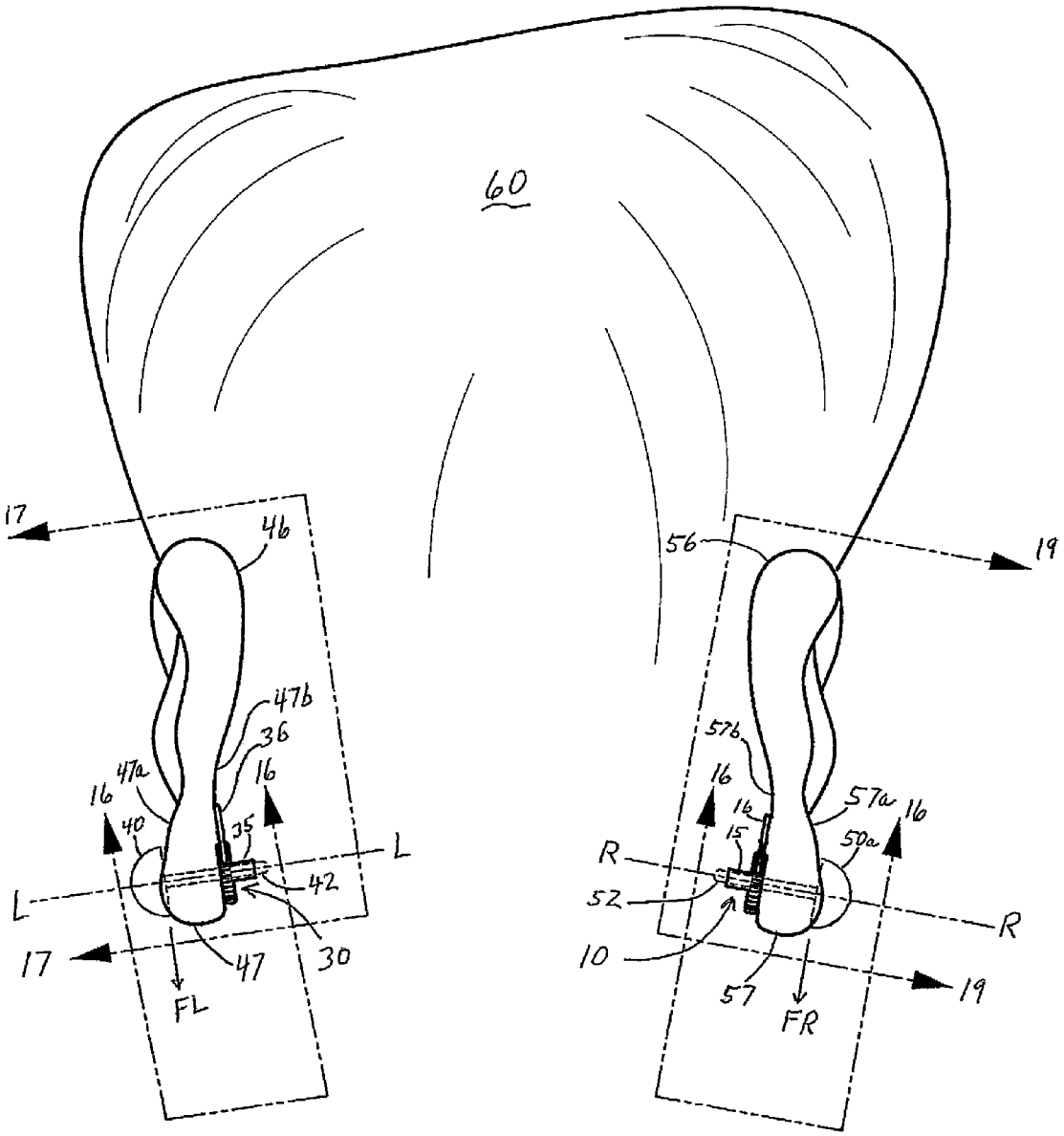
FIG. 15 is a rear view of a head of a person wearing the right and left earring support backings of FIGS. 1 and 8 on post earrings.

Referring to FIG. 15, a rear view of a head 60 of a person having a left ear 46 with a left earlobe 47 and a right ear 56 with a right earlobe 57 is shown. Left earlobe 47 has a front side 47*a* and a back side 47*b*. Right ear lobe 57 has a front side 57*a* and a back side 57*b*. Right earring support 10 is shown attached to a post earring 50 and left earring support 30 is shown attached to post earring 40. Post earring 50 has a post 52. Post earring 40 has a post 42.

Left ear 46 is shown with an axis line L-L drawn through post 42 of earring 40. Shown in close proximity thereto is a downward force arrow FL, left side, which also indicates the downward tilting direction of axis L-L. The downward force FL results from the weight or size of an earring 40. As shown worn on left ear 46, the earlobe 47 attempts to droop downward in the direction of force FL because of the weight of earring 40. However any tendency to droop in the downward direction of force FL of earring 40, due to the weight of earring 40, is prevented by stabilizer support 36 engaging with the backside 47*b* of earlobe 47. The backside 47*b* of earlobe 47 supports the stabilizer support 36 which is lodged against the backside 47*b* of earlobe 47. Accordingly, earring 40 is prevented from drooping downward.

Right ear 56 is shown with an axis line R-R drawn through post 52 of earring 50. Shown in close proximity thereto is a downward force arrow FR, right side, which also indicates the downward tilting direction of axis R-R. The downward force FR is the result of the weight or size of an earring 50, as shown worn on right ear 56, and right earlobe 57 attempts to droop downward in the direction of force arrow FR of the weight of earring 50. However any tendency to droop in the downward direction of force arrow FR, due to the weight of earring 50, is prevented by stabilizer support 16 engaging with the backside 57*b* of right earlobe 57. The backside 57*b* of right earlobe 57 supports the stabilizer support 16 which is lodged against the backside 57*b* of right earlobe 57. Accordingly, earring 50 is prevented from drooping downward.

Figure 16:
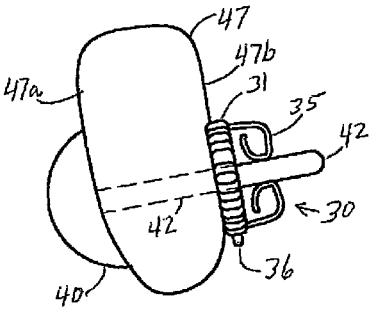
FIG. 16 is a bottom view of a left earring, taken along line 16-16 of FIG. 15 showing the left earring and the post of the left earring on the earlobe of the left ear.
Figure 17:
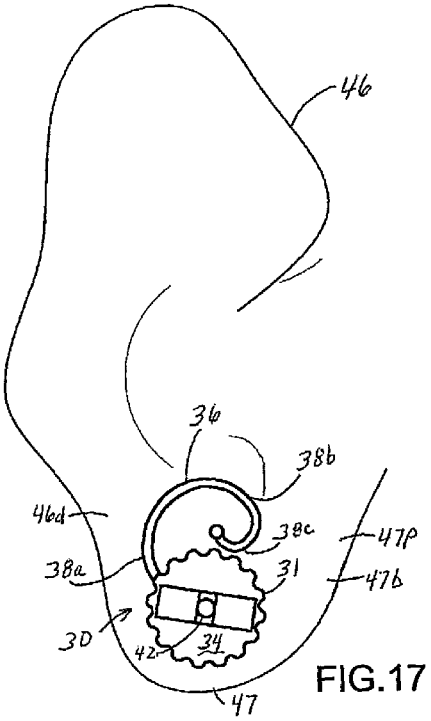
FIG. 17 is a rear view of the left ear, showing the relationship of the left ear to the earring support backing and stabilizer taken along line 17-17 of FIG. 15.

Referring to FIG. 16, a bottom view of a left earring 40, taken along line 16-16 of FIG. 15 is shown. post 42 of earring 40 passes through left earlobe 47 and through the post hole 32 (as shown in FIG. 8) of earring retainer 31 where post 42 is held in place by fastening clip 35 to secure earring 40 to left ear 46 and ear lobe 47. The first face 33 of earring retainer 31 is urged against the backside 47*b* of earlobe 47. As can be seen in FIG. 17, stabilizer support 36 is urged by retainer 31 against backside 47*b* of earlobe 47. Stabilizer 36 acts as a cantilever against backside 47*b*, bracing earring support backing 30 against the backside 47*b* of earlobe 47 and prevents earring 40 from moving in the direction of force arrow FL and from drooping downward. Earlobe 47 includes an interior side 46*p* proximal to the head 60, and an outer edge 46*d* distal to the head 60.

Figure 18:
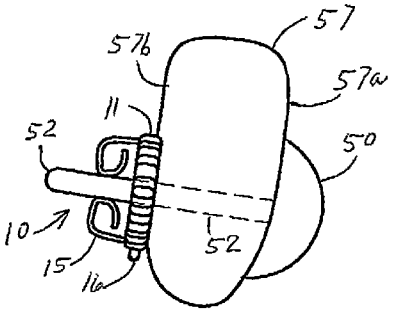
FIG. 18 is a bottom view of the right earring, taken along line 18-18 of FIG. 15 showing the right earring and the post of the right earring on the earlobe of the right ear.
Figure 19:
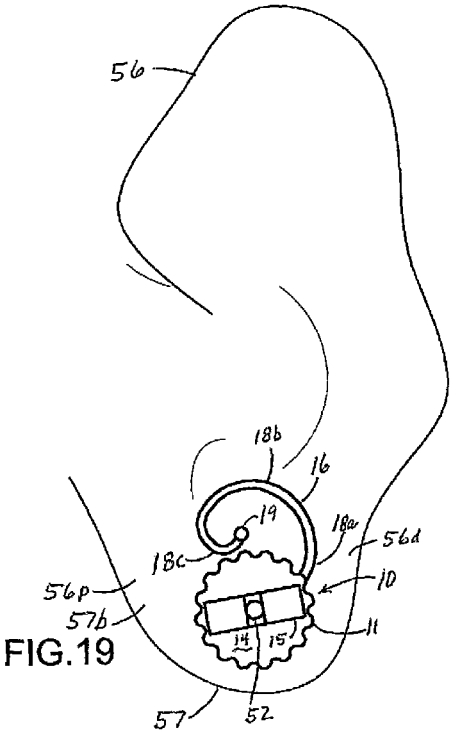
FIG. 19 is a rear view of the right ear, showing the relationship of the right ear to the earring support backing and stabilizer taken along line 19-19 of FIG. 15.

Referring now to FIG. 18, a bottom view of a right earring 50, as viewed from the rear of the head 60, taken along line 18-18 of FIG. 15 is shown. Post 52 of earring 50 passes through right earlobe 57 and through the post hole 12 (as shown in FIG. 1) of earring retainer 11 where post 52 is held in place by fastening clip 15 to secure right earring 50 to right ear 56 and right ear lobe 57. The first face 13 of earring retainer 11 is urged against the backside 57*b* of earlobe 57. As can be seen in FIG. 19, stabilizer support 16 is urged by retainer 11 against backside 57*b* of right earlobe 57. Stabilizer 16 acts as a cantilever against backside 57*b*, bracing earring support backing 10 against the backside 57*b* of right earlobe 57 and prevents earring 50 from moving in the direction of force arrow FR and from drooping downward. Right earlobe 57 includes an interior side 56*p* proximal to the head 60, and an outer edge 56*d* distal to the head 60.

When the left earring support backing 30 is attached to the left earring 40 with a post 42 passing through center opening 32, first face 33 of earring retainer 31 is immediately adjacent the interior backside 47*b* of left ear lobe 47 as viewed from the back of the head 60 as shown in FIGS. 15, 16 and 17. The earring retainer 31 receives the post 42 to fit through post hole 32, where the terminal end of post 42 is received through the post hole 32 and fastened by the fastening clip 35. When the earring support backing 30 with retainer 31 is attached to an earring 50, retainer 31 is axially moved along the post 42, along line L-L of FIG. 15, until earring retainer 31 fits comfortably against the rear backside 47*b* of ear lobe 47. The wearer determines the amount of pressure retainer 31 and stabilizer support 36 exert against the backside 47*b* of earlobe 47 by adjustment of the retainer 31 on post 42 in relation to earlobe 47. Fastening clip 35 acts as a spring which frictionally engages the post 42, this causes both the stabilizer support 36 and the earring retainer 31 to be secured in supporting contact against the backside 47*b* of the earlobe 47. The position of the stabilizer support 36 and the earring retainer 31 being urged against the backside 47*b* of earlobe 47 reinforces the natural support present in the anatomy of the right ear 56 and right earlobe 57. The added support of the stabilizer support 36 and the earring retainer 31 permits greater force to be applied. This reduces the droopy ear effect and allows a greater weight of an earring to be comfortably supported on an ear 46 and earlobe 47 to maintain the earring 40 in a desired and non-drooping position.

When the right earring support backing 10 is attached to the right earring 50 with a post 52 passing through center opening 12, first face 13 of the earring retainer 11 is immediately adjacent the interior backside 57*b* of right earlobe 57 as viewed from the back of the head 60 as shown in FIGS. 15, 18 and 19. The earring retainer 11 receives the post 52 to fit through post hole 12, where the terminal end of post 52 is received through the post hole 12 and fastened by the fastening clip 15. When the earring support backing 10 with retainer 11 is attached to an earring 50, retainer 11 is axially moved along the post 52, along line R-R of FIG. 15, until earring retainer 11 fits comfortably against the rear backside 57*b* of right earlobe 57. The wearer determines the amount of pressure retainer 11 and stabilizer support 16 exert against the backside 57*b* of right earlobe 57 by adjustment of the retainer 11 on post 52 in relation to right earlobe 57. Fastening clip 15 acting as a spring which frictionally engages the post 52, this causes both the stabilizer support 16 and the earring retainer 11 to be secured in supporting contact against the backside 57*b* of the right earlobe 57. The position of the stabilizer support 16 and the earring retainer 11 being urged against the backside 57*b* of right earlobe 57 reinforces the natural support present in the anatomy of the right ear 56 and right earlobe 57. The added support of the stabilizer support 16 and the earring retainer 11 permits greater force to be applied. This reduces the droopy ear effect and allows a greater weight of earring to be comfortably supported on the right ear 56 and right earlobe 57 to maintain the earring 50 in a desired and non-drooping position.

As seen in FIG. 17, a rear view taken along line 17-17 of FIG. 15 of left ear 46 showing the relationship of the left ear 46 to the retainer 31 and stabilizer support 36. The front face 33 of the retainer 31 and the stabilizer support 36 are urged against the backside 47*b* of earlobe 47. As can be seen in FIG. 17, post 42 is held in place by fastening clip 35 to secure earring 40, earring retainer 31, first face 33 and stabilizer support 36 to the backside 47*b* of left ear lobe 47.

As seen in FIG. 19, a rear view taken along line 19-19 of FIG. 15 of the right ear 56 showing the relationship of the right ear 56 to the retainer 11 and stabilizer support 16. The front face 13 of the stabilizer 11 and stabilizer support 16 are urged against backside 57*b* of earlobe 57. As can be seen in FIG. 19, post 52 is held in place by fastening clip 15 to secure earring 50, earring retainer 11, first face 13 and stabilizer support 16 to backside 57*b* of right ear lobe 57.

As seen in FIG. 17 stabilizer support 36 and retainer 31 provide reinforcing support to the backside 47*b* of earlobe 47 and provides greater comfort for the wearer wearing a heavier earring 40. The stabilizer support 36 has a first arcuate portion 38*a*, which extends from the first point 37, starts a spiral path up and to the right, the first arcuate portion 38*a* transitions into a second arcuate portion 38*b* which has a spiral path down and to the right and transitions into a third arcuate portion 38*c* which spirals up and to the left. The stabilizer support 36 terminates at a spherical terminal free end 39. As seen in FIG. 17, the first portion 38*a*, the second portion 38*b*, and the third portion 38*c* are integral and form a spiral. The spiral formed by the stabilizer support 36 provides a continuous support that reinforces the backside 47*b* of earlobe 47, where the first arcuate portion 38*a* presses against, reinforces and supports the distal portion 46*d* of the distal outer edge 46*d* of the backside 47*b* of the earlobe 47. Portion 38*a* of stabilizer support 36 reinforces and supports the outer edge 46*d* of earlobe 47, also causing the outer edge 46*d* not to droop or be deformed by the weight and size of earring 40. It is also noted that the stabilizer support portions 38*b* and 38*c* have a size and shape which provides clearance toward the proximal portions 46*p* of earlobe 47 so as to avoid irritation at the proximal portion 46*p* of earlobe 47. Specifically, the retainer 31, stabilizer support 36, fastening clip 35, post 42 and portion 38*b* and 38*c* are dimensioned to provide clearance to proximal portion 46*p* of earlobe 47 and head 60.

As seen in FIG. 19 stabilizer support 16 and retainer 11 provides reinforcing support to the backside 57*b* of earlobe 57 and provides greater comfort for the wearer wearing a heavier earring 50. The stabilizer support 16 has a first arcuate portion 18*a*, which extends from the first point 17, starts a spiral path up and to the left, the first arcuate portion 18*a* transitions into a second arcuate portion 18*b* which has a spiral path down and to the left and transitions into a third arcuate portion 18*c* which spirals up and to the right. The stabilizer support 36 terminates at a spherical terminal free end 19. As seen in FIG. 19, the first portion 18*a*, the second portion 18*b*, and the third portion 18*c* are integral and form a spiral. The spiral formed by the stabilizer support 16 provides a continuous support that reinforces the backside 57*b* of earlobe 57, where the first arcuate portion 18*a* presses against, reinforces and supports the distal portion 56*d* of the outer edge of the backside 47*b* of the earlobe 57. Portion 18*a* of stabilizer support 16 reinforces and supports the outer edge 56*d* of earlobe 57, also causing the outer edge 56*d* not to droop or be deformed by the weight and size of earring 50. It is also noted that the stabilizer support portions 18*b* and 18*c* have a size and shape which provides clearance toward the proximal portions 56*p* of earlobe 57 so as to avoid irritation at the proximal portion 56*p* of earlobe 57. Specifically, the retainer 11, stabilizer support 16, fastening clip 15, post 52 and portion 18*b* and 38*c* are dimensioned to provide clearance to proximal portion 56*p* of earlobe 57 and head 60.

Figure 20:
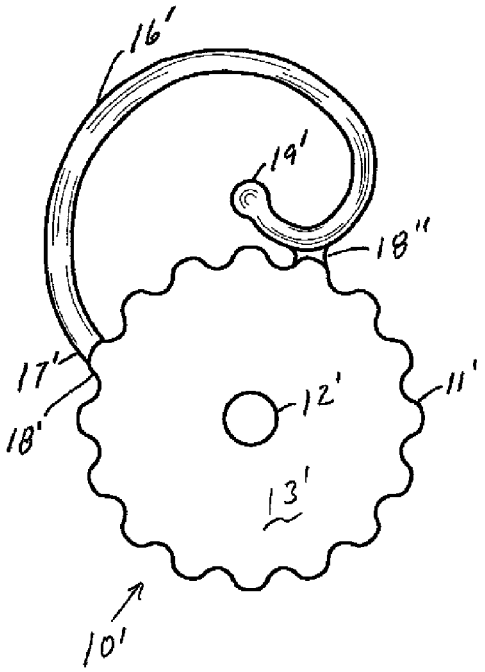
FIG. 20 is a front view of another embodiment of the invention showing a right curlycue earring support with a second attachment location.

Referring now to FIG. 20, a front view of a second embodiment of a right curlycue earring support backing 10' is shown. The right curlycue earring support backing 10' has an earring retainer 11' with a post hole 12'. Retainer 11' has a first face 13' and a second face 14' opposite the first face 13'. The second face 14' has a fastening clip 15' (not shown, but equivalent to fastening clip 15 shown in FIG. 4), as known in the art, for fastening the first earring support 10' to an earring to be worn in a respective ear.

Earring retainer 11' has a stabilizer support 16' shown as a wire, the stabilizer support 16', having a first point 17' at a first attachment location/intersection 18' on the retainer 11'. The stabilizer support 16' extends from retainer 11' to a free end 19' of the stabilizer support 16' spaced apart from the retainer 11'. Prior to the free end 19', the stabilizer support 16' is welded, soldered or otherwise affixed (i.e. stamped, molded or cast) at a second attachment location/intersection 18" to the retainer 11'. The second attachment intersection 18" improves the structural integrity of the stabilizer support 16'. The free end 19' is at the terminal end of a generally spiral path clockwise from the first attachment intersection 18' when viewing the retainer 11' in a direction from the first face 13' of the retainer 11'. The free end 19' may be spherical.

Figure 21:
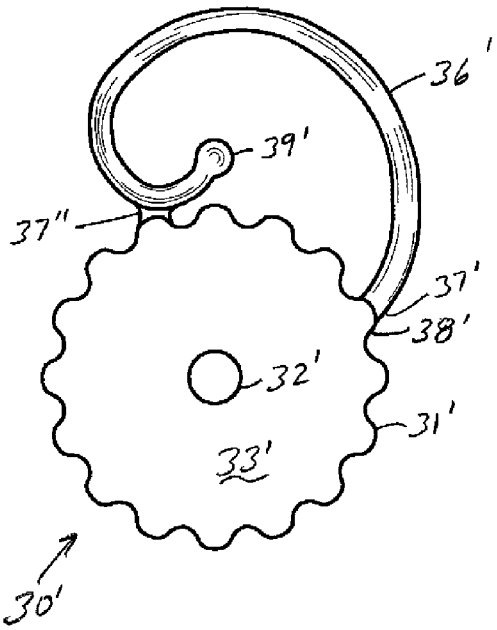
FIG. 21 is a front view of the embodiment according to FIG. 20 showing a left curlycue earring support with a second attachment location.

Referring to FIG. 21, a front view of a second embodiment of a second or left curlycue earring support 30' is shown. The left curlycue earring support backing 30' has an earring retainer 31' with a post hole 32'. Retainer 31' has a first face 33' and a second face 34' opposite the first face 33'. The second face 34' has a fastening clip 35' (not shown, but equivalent to fastening clip 35 shown in FIG. 11) as known in the art, for fastening the second earring support 30' to an earring to be worn in a respective ear.

Earring retainer 31' has a stabilizer support 36' having first point 37' at first attachment location/intersection 38' on retainer 31'. The stabilizer support 36' extends from retainer 31' to a free end 39' of the stabilizer support 36' spaced apart from the second retainer 31'. Prior to the free end 39', the stabilizer support 36' is welded or soldered at a second attachment location/intersection 37" to the retainer 31'. The second attachment intersection 37" improves the structural integrity of the stabilizer support 36'. The free end 39' is at the terminal end of a generally spiral path counterclockwise from the first attachment intersection 38' when viewing the retainer 31' in a direction from the first face 33' of the retainer 31'. The free end 39' may be spherical.

Both combinations of the alternative embodiment earring retainers 31', 11' and stabilizer supports 36', 16' may be divided into portions of spiral curves as has been described with respect to FIGS. 17 and 19.

Figure 26:
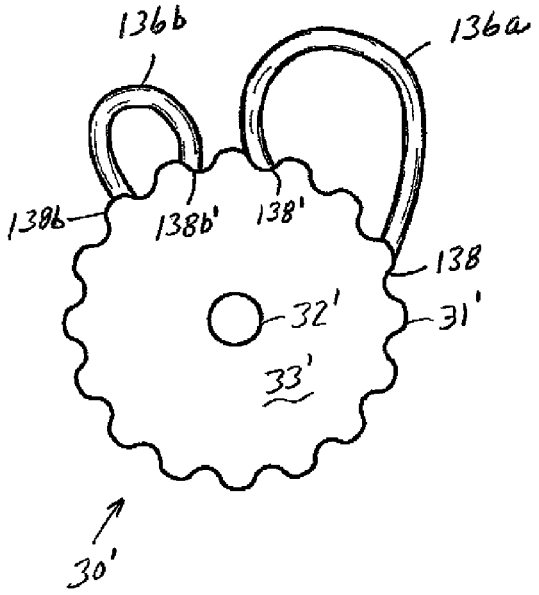
FIG. 26 is a front view according to the embodiment of FIG. 25 of a left earring support backing for the left ear.
Figure 27A:
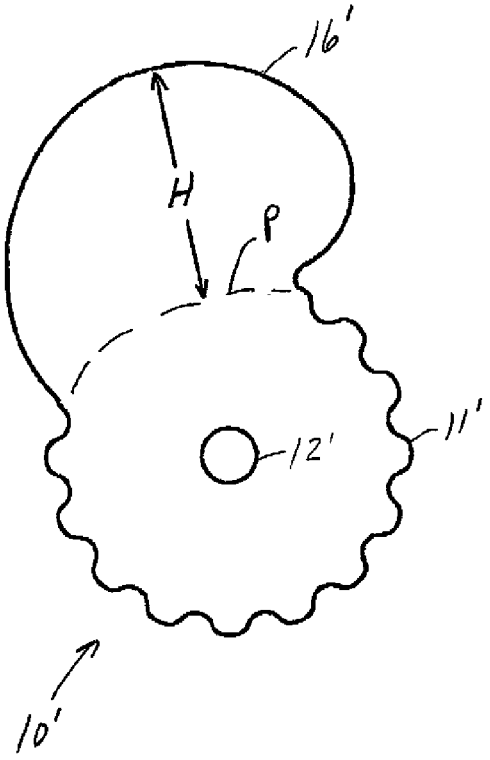
FIG. 27A is a front view of another embodiment of a right earring support backing for the right ear.
Figure 27B:
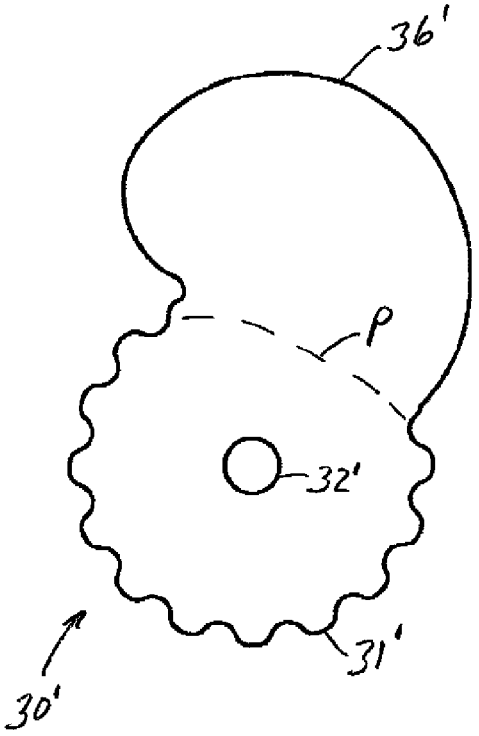
FIG. 27B is a front view of another embodiment of a left earring support backing for the left ear.
Figure 27C:
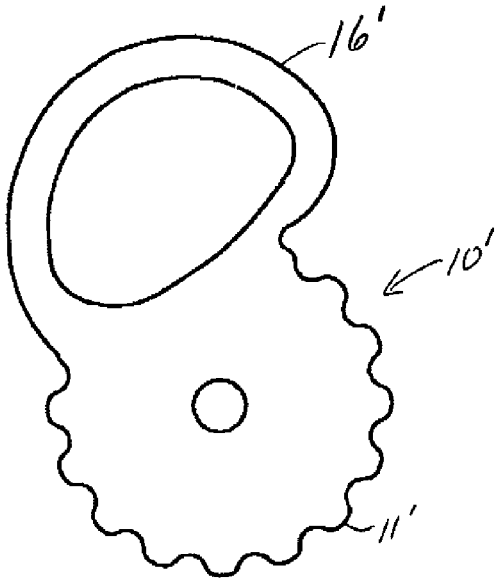
FIG. 27C is a front view of another embodiment of a right earring support backing for the right ear.
Figure 27D:
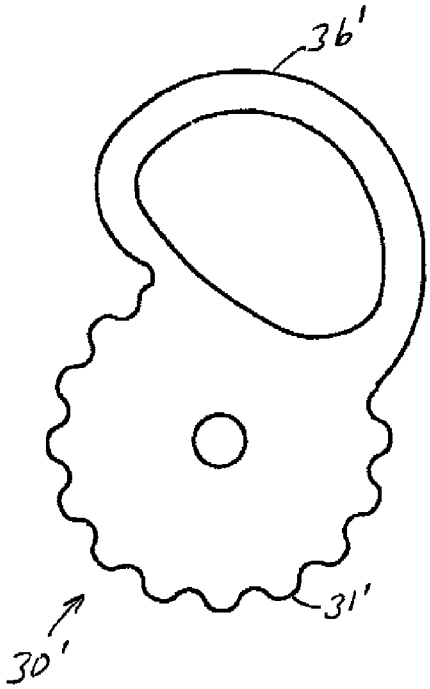
FIG. 27D is a front view of another embodiment of a left earring support backing for the left ear.
Figure 27E:
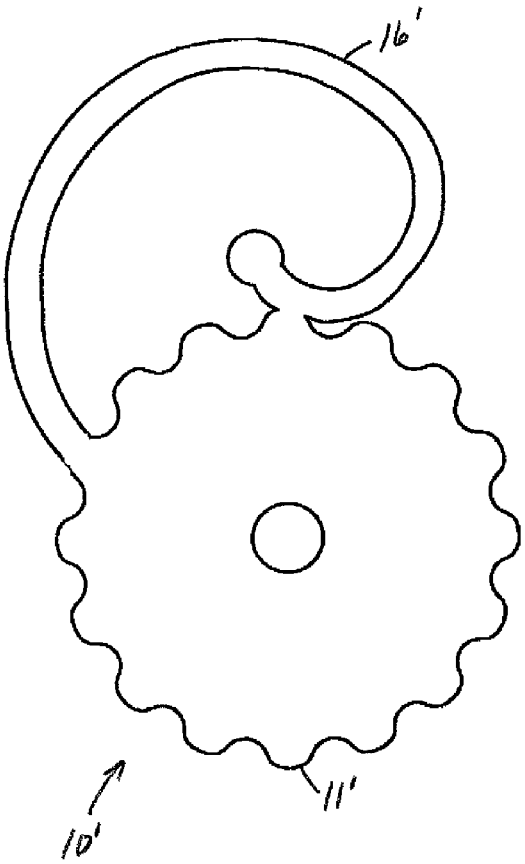
FIG. 27E is a front view of another embodiment of a right earring support backing for the right ear.
Figure 27F:
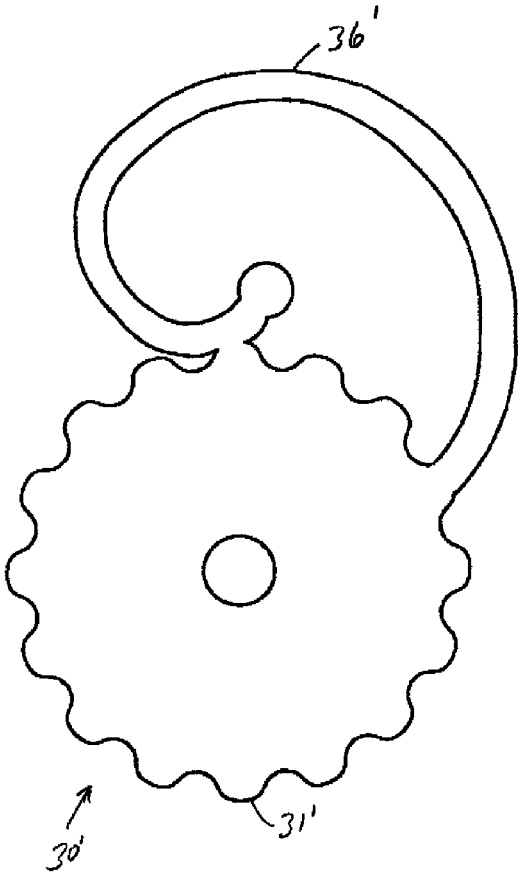
FIG. 27F is a front view of another embodiment of a left earring support backing for the left ear.

FIGS. 27A and 27B show a variation of the embodiment of FIGS. 20 and 21, where the stabilizer support 16' and 36' is provided as a solid portion which extends from the retainer plate 11' and 31'. In this variation, the outer edge of the stabilizer support 16' and 36' corresponds roughly to the curlycue shape of FIGS. 20 and 21 with the exception that the stabilizer support does not include the terminal end 19' or 39'. In this variation, because the retainer plate and the stabilizer support blend into a common piece, the attachment location is to be considered a portion P of the retainer plate which extends along a perimeter of the retainer plate if the perimeter were projected with its profile between the beginning and end of the stabilizer support. Accordingly, the attachment end of the stabilizing support matches the portion P of the retainer plate. Although FIGS. 27A and 27B have a similar shape to FIGS. 20 and 21, it is certainly possible for the solid portion(s) to correspond to other embodiments disclosed herein for example FIGS. 23 to 26. Furthermore, in the manner noted above with respect to FIGS. 20 and 21, the outer edge of the stabilizer supports 16' and 36' may be divided into portions of spiral curves as has been described with respect to FIGS. 17 and 19.

FIGS. 27C to 27F simply show that the core of the stabilizer supports 16' and 36' of FIGS. 27A and 27B have been provided with an opening, which can provide material savings or aesthetic design options.

As noted above, the variations shown in FIGS. 27A-27F show that the stabilizer supports 16' and 36' are asymmetrical. The variations shown in FIGS. 27A-27F also show that the stabilizer supports 16' and 36' have a height H, the height is 25% to 150% of the mean diameter of the retainer plate 11' and 31'. The height H also applies to the other embodiments including those of wire construction. Where the height H is measured normal from the perimeter of the retainer plate whether actual or virtual (portion P) to the furthest position on the stabilizer support.

The variations shown in FIGS. 27A-27F can be manufactured by molding or stamping and accordingly have the physical characteristics of being produced by such processes.

This second embodiment of the left and right earring supports 10' and 30' with the second connection points 18" and 37" increases the durability of the stabilizer supports 16' and 36'. The left and right earring support backings of the second embodiment function substantially as described in the first embodiment.

Figure 22:
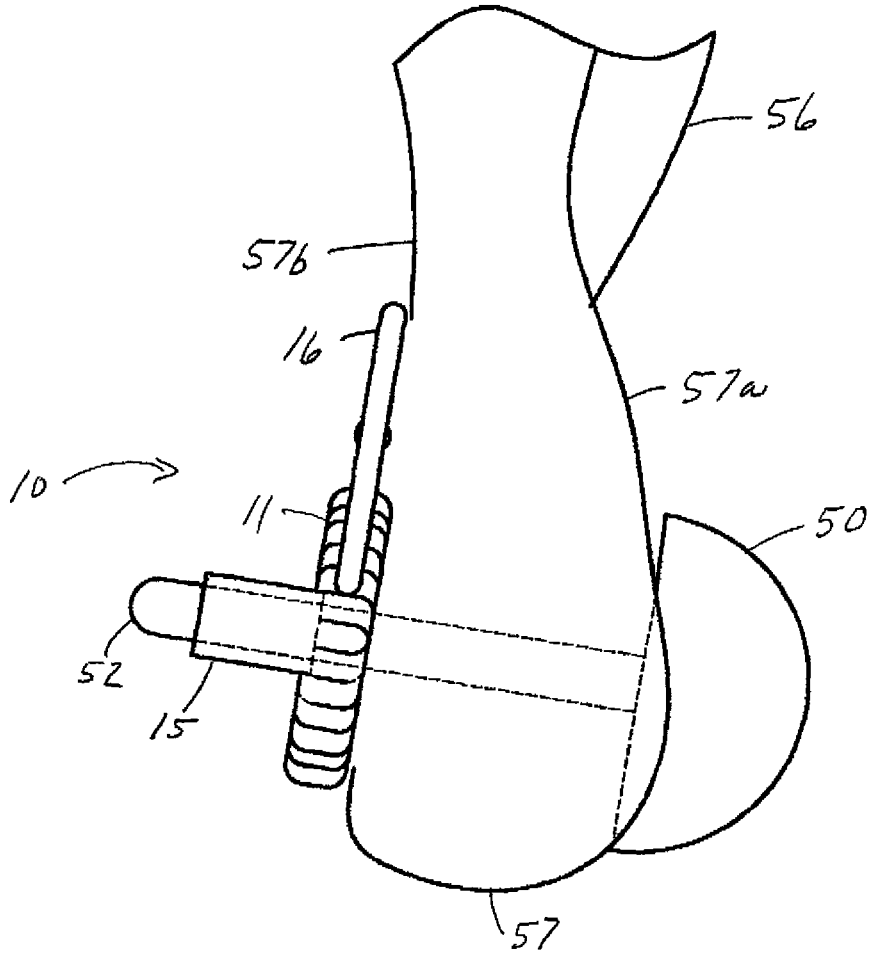
FIG. 22 is a side view of the right earlobe with an earring and a right earring support backing of FIG. 1.

FIG. 22 is a side view of a portion of the right ear. This shows the stabilizer support 16 in contact with the backside 57*b* of earlobe 57. Though FIG. 22 shows right ear 56 and earring support backing 10, the earring support backing 30 functions the same for the left ear 46 as described herein.

It is to be understood that the earring retainers 11, 31, 11', 31', and the respective earring stabilizer supports 16, 36, 16', 36' are not limited to the geometrical structures which are shown and described in the figures and specification herein. Other constructions of the earring stabilizer supports 16, 36, 16', 36' are within the scope of the invention. These include, but are not limited to, triangular forms with one end affixed to the earring retainers 11, 31, 11', 31', in the same opposite orientation respectfully as the curlycues here-before described, star shapes, pentagons, hexagons, octagons, other spirals, archimedian spirals, a golden spiral and other euclidean or non-euclidean geometric constructs.

Figure 23:
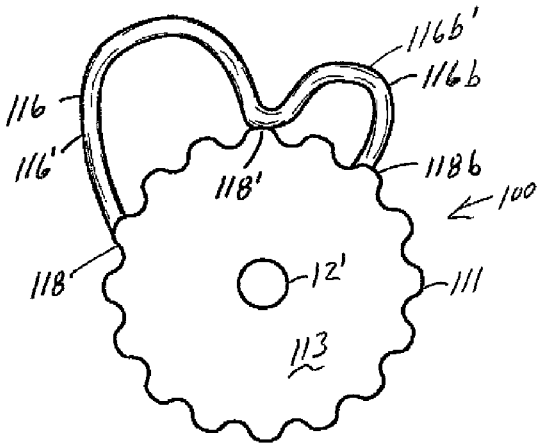
FIG. 23 is a front view of another embodiment of a right earring support backing for the right ear.
Figure 24:
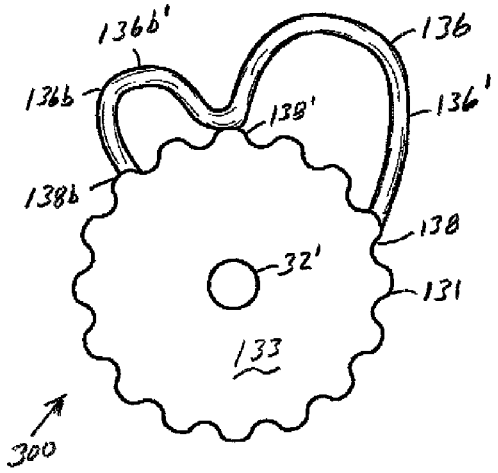
FIG. 24 is a front view according to the embodiment of FIG. 23 of a left earring support backing for the left ear.

A third embodiment of the invention is shown in FIGS. 23 and 24. In FIG. 23, right earring support backing 100 for the right ear 56, includes a stabilizer support 116 having a first attachment location/intersection 118 at the retainer 111 and a second attachment location/intersection 118' at the retainer 111 and a first face 113. Stabilizer support 116 includes a second stabilizer support portion 116*b* with a third attachment location/intersection 118*b* at the retainer 111. Stabilizer support 116*b* is slightly smaller than stabilizer support 116 to accommodate the anatomical features of the backside of the right ear 56. In FIG. 24, left earring support backing 300 for a left ear 46, includes a stabilizer support 136 having a first attachment location/intersection 138 at the retainer 131 and a second attachment location/intersection 138' at the retainer 131 and a first face 133. Stabilizer support 136 includes a second stabilizer support portion 136*b* with a third attachment location/intersection 138*b* at the retainer 131. Stabilizer support 136*b* is slightly smaller than stabilizer support 136 to accommodate the anatomical features of the backside of the left ear 46.

These third embodiments, have substantially similar benefits as previously described for the first and second embodiments. This includes the stabilizers 116 and 116*b* having arcuate portions where arcuate portion 116' supports the distal portion of the earlobe and arcuate portion 116*b'* is sufficiently small enough as to not be within the proximal portion of the earlobe as heretofore described. Likewise, stabilizers 136 and 136*b* have arcuate portions, where arcuate portion 136' supports the distal portion of the earlobe and arcuate portion 136*b'* is sufficiently small enough as to not be within the proximal portion of the earlobe as heretofore described.

Figure 25:
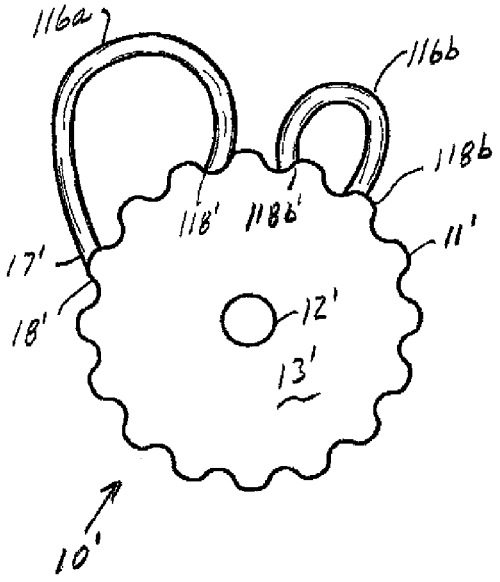
FIG. 25 is a front view of another embodiment of a right earring support backing for the right ear.

FIGS. 25 and 26 show a variation of the third embodiment in which the stabilizer support members 116 and 136 have been separated in two individual portions 116*a*, 116*b*, and 136*a*, 136*b*, which requires an additional attachment location/intersection 118*b'* and 138*b'*. When considering the asymmetry of the variation shown in FIGS. 25 and 26, the asymmetry is considered with respect to both portions 116*a*, 116*b*, and 136*a*, 136*b*. Therefore, while the individual portions 116*a*, 116*b*, and 136*a*, 136*b*, may be symmetrical themselves, when considered as a complete stabilizer support, the complete stabilizer support is asymmetrical.

Figure 28:
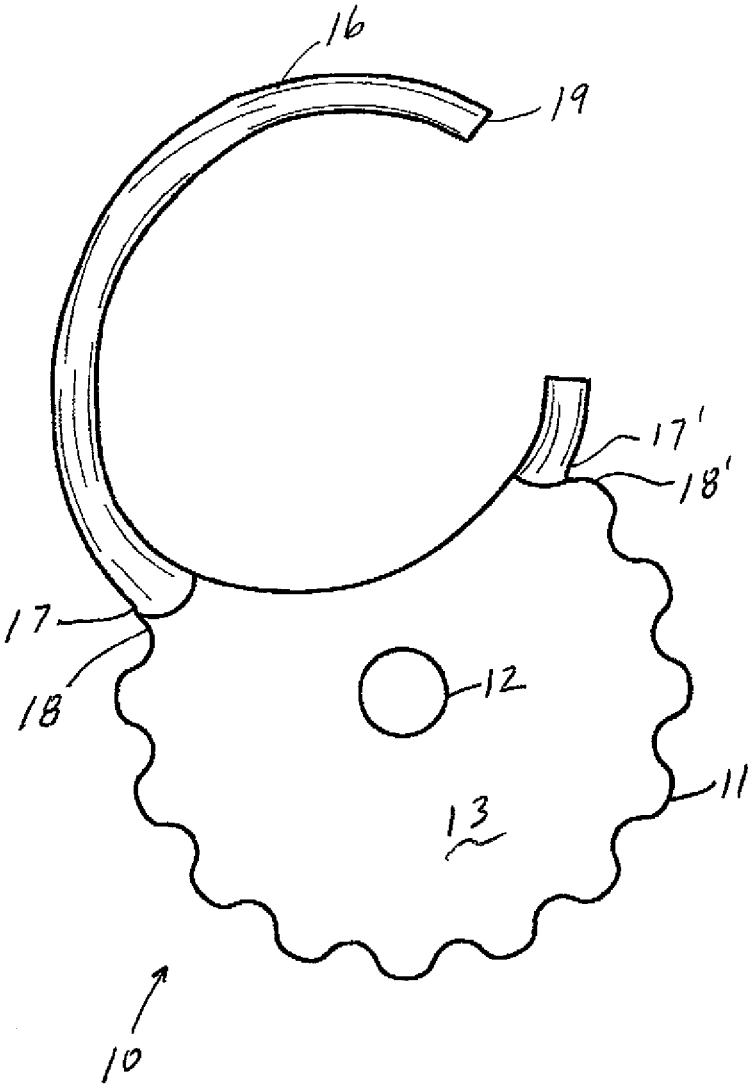
FIG. 28 is a front view of another embodiment of a right earring support backing for the right ear.
Figure 29:
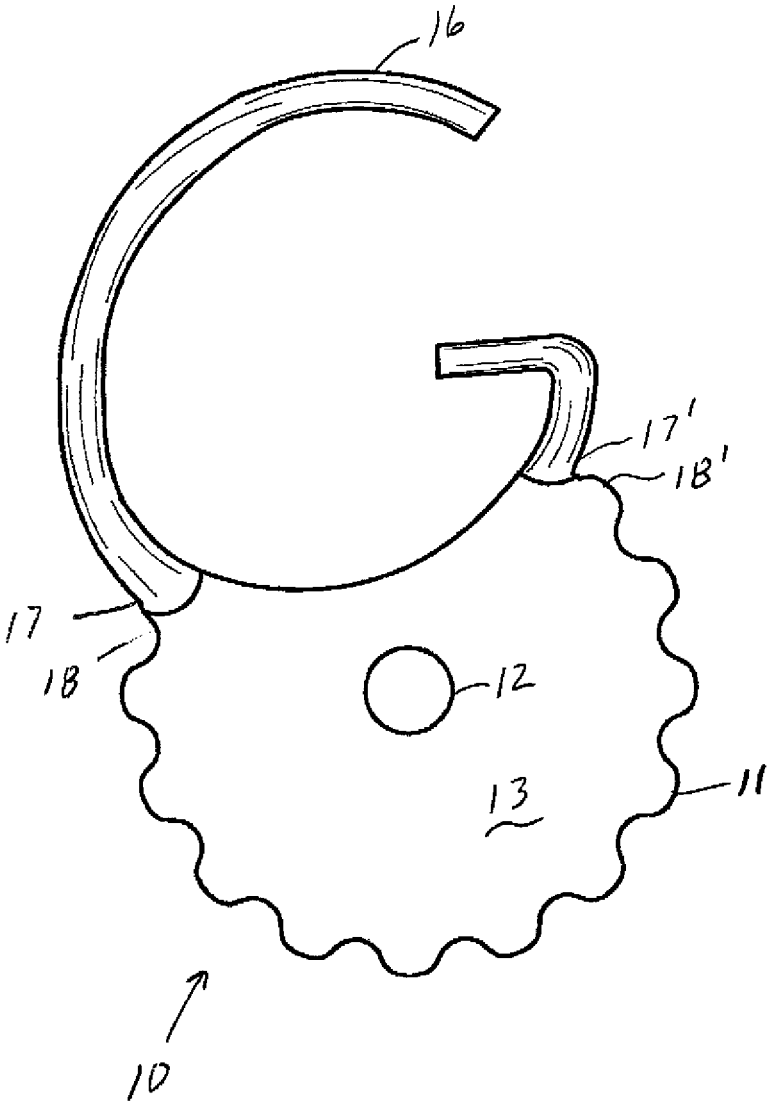
FIG. 29 is a front view of another embodiment of a right earring support backing for the right ear.
Figure 30:
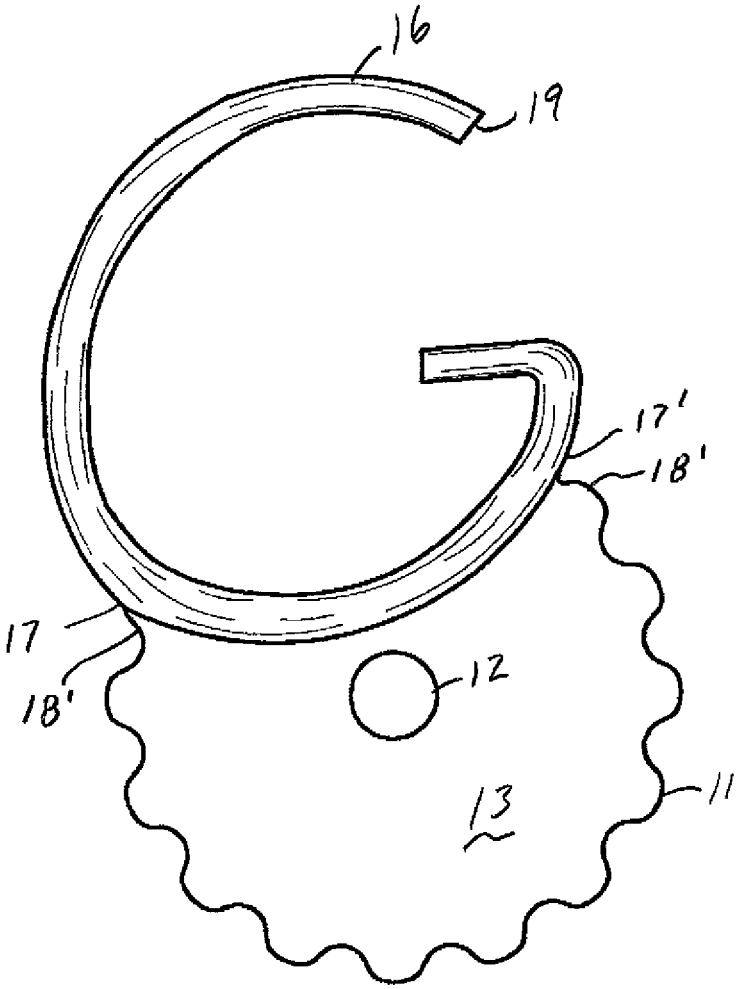
FIG. 30 is a front view of another embodiment of a right earring support backing for the right ear.

FIGS. 28 to 30 show embodiments of the earring support 10 where the retainer plate 11 is shaped to define a portion of a symbol represented by the stabilizer support 16, for example a "C" or a "G". These stabilizers can have the construction of any of the above noted embodiments.

Figure 31:
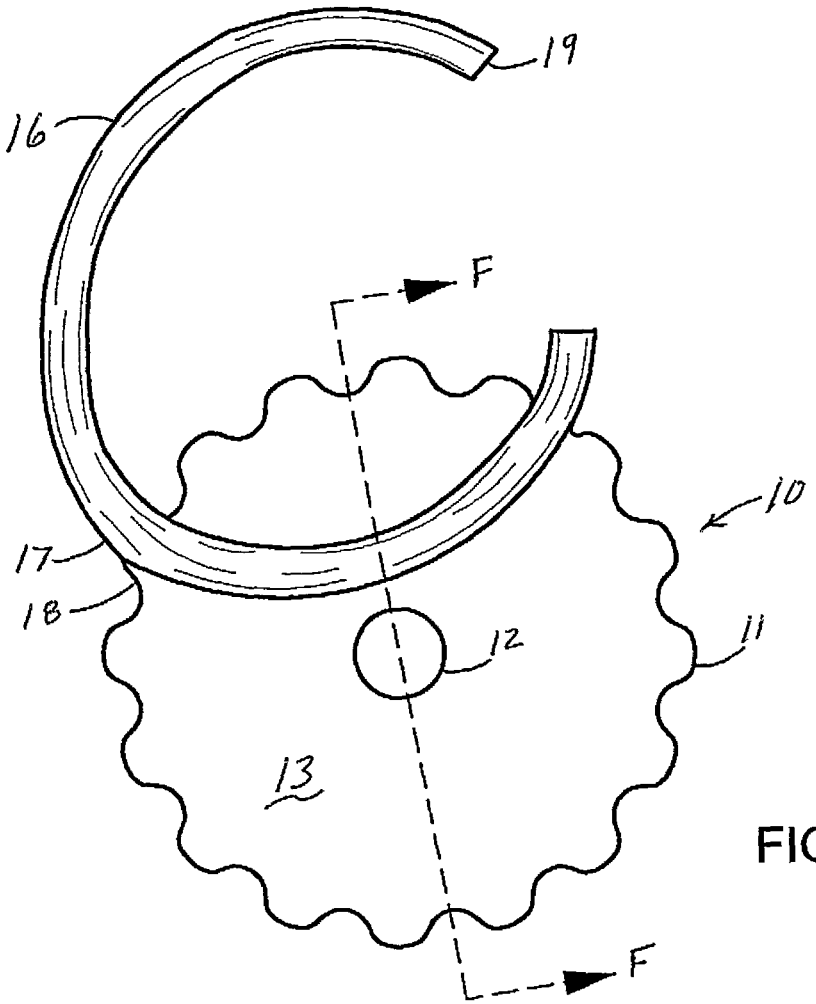
FIG. 31 is a front view of another embodiment of a right earring support backing for the right ear.
Figure 32:
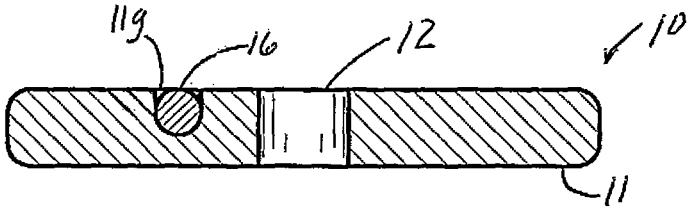
FIG. 32 is a section view of FIG. 31 taken along section line F-F.

FIG. 31 shows an embodiment where the stabilizer support 16 traverses across the retainer plate 11. Here, as shown in FIG. 32, it is possible for the retainer plate 11 to have a groove 11*g* formed therein for accommodating the stabilizer support 16 therein. This prevents the stabilizer support 16 shown as a wire from irritating the back of the ear.

Figure 33:
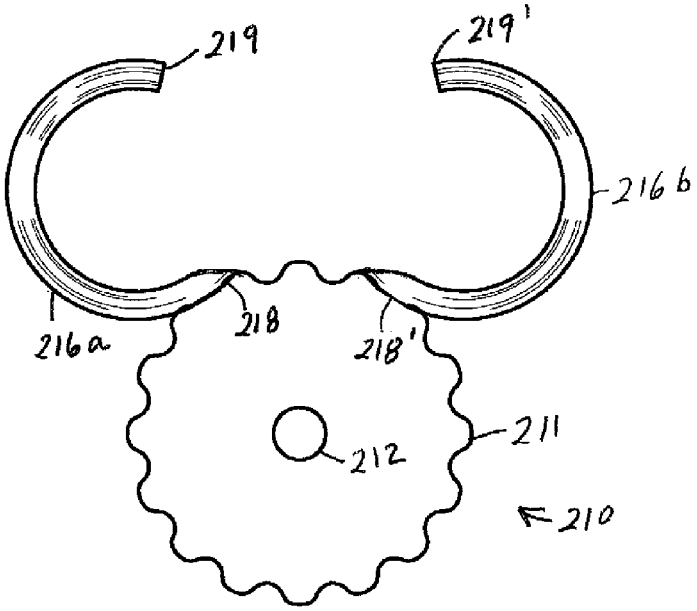
FIG. 33 is a front view of another embodiment of an earring support backing.
Figure 34:
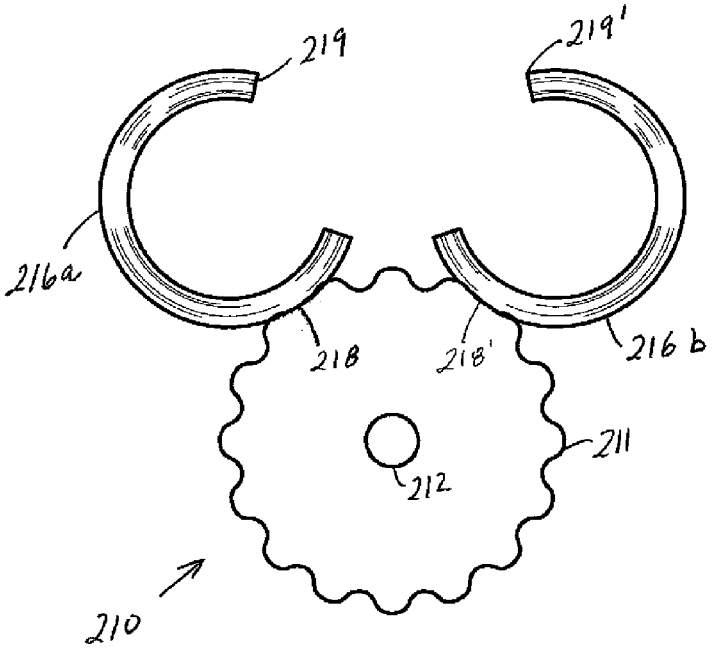
FIG. 34 is a front view of another embodiment of an earring support backing

FIGS. 33 and 34 show embodiments of the earring support 210 where the stabilizer has two portions 216*a* and 216*b*. Each of the portions 216*a* and 216*b* has a free end 219 and 219' and attachment locations 218 and 218'. The earring support 210 has a retainer plate 211 with a post hole 212.

While the invention has been describe in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

We claim:

1. A pair of earring supports for a pair of earrings having earring posts, the pair of earring supports comprising:

retainer plates, each retainer plate respectfully having:

a post hole formed therein;

a first face configured for engaging an ear;

a second face opposite said first face;

a fastening clip at said second face, said fastening clip configured for engaging an earring post passing through said post hole; and a stabilizing support having an attachment point affixed at an attachment intersection on said retainer plate, said stabilizing support extending from said retainer plate to a free end of said stabilizing support spaced apart from said retainer plate and being shaped and sized to hide entirely behind an earlobe of a wearer of said retainer plates;

said free end of a first retainer plate having a terminal point, the free end being counterclockwise from said first attachment intersection of said first retainer plate when viewing said first retainer plate in a direction towards said second face of said first retainer plate; and said free end of a second retainer plate having a terminal point, the free end being clockwise from said attachment intersection of said second retainer plate when viewing said second retainer plate in a direction towards said second face of said second retainer plate.

2. The earring support as in claim 1 wherein said stabilizer support defines a cantilever between the attachment point and the free end.

3. An earring support for an earring having an earring post, the earring support comprising:

a retainer plate having a post hole formed therein, a first face configured for engaging an ear, and a second face opposite said first face;

a fastening clip at said second face, said fastening clip configured for engaging an earring post passing through said post hole; and said retainer plate having a stabilizing support, said stabilizing support being shaped and sized to hide entirely behind an earlobe of a wearer and having an attachment point affixed at an attachment intersection on said retainer plate, said stabilizing support including a free end having a terminal point, the free end extending from said retainer plate in a direction that is one of clockwise or counterclockwise from said attachment intersection when viewing said retainer plate in a direction towards said second face of said retainer plate.

4. The earring support according to claim 3, wherein said stabilizing support is formed of wire.

5. The earring support according to claim 3, wherein said retainer plate has a second stabilizing support, said second stabilizing support having a second attachment point affixed at a second attachment intersection on said retainer plate, said second stabilizing support extending from said retainer plate in a direction that is one of clockwise or counterclockwise from said second attachment intersection when viewing said retainer plate in a direction towards said second face of said retainer plate.

6. The earring support according to claim 5, wherein said stabilizing supports are formed of wire.

7. The earring support as in claim 5 wherein said first stabilizer support and said second stabilizer support are in contact.

8. An earring support for an earring having an earring post, the earring support comprising:

a retainer plate having a post hole formed therein, a first face configured for engaging an ear, and a second face opposite said first face;

said second face having a fastening clip configured for engaging an earring post passing through said post hole; and said retainer plate having a stabilizing support, said stabilizing support being shaped and sized to hide entirely behind an earlobe of a wearer and having an end affixed at an attachment location on said retainer plate, said stabilizing support extending in a spiral from said retainer plate to a free end of said stabilizing support spaced apart from said retainer plate, said free end of said stabilizing support having a terminal point.

9. The earring support as in claim 8 wherein, said free end is at a position which is one of clockwise or counterclockwise from said attachment location when viewing said retainer plate in a direction towards said second face of said retainer plate.

10. An earring support for an earring having an earring post, the earring support comprising:

a retainer plate having a post hole formed therein, a first face configured for engaging an ear, and a second face opposite said first face, said first face defining a plane substantially normal to said post hole;

a fastening clip at said second face, said fastening clip configured for engaging an earring post passing through said post hole;

said retainer plate having a stabilizing support, said stabilizing support having an attachment end affixed at an attachment location on said retainer plate, said stabilizing support extending from said attachment location; and said stabilizing support being shaped and sized to hide entirely behind an earlobe of a wearer and being asymmetrical along all planes spanning from said post hole to said stabilizing support.

11. The earring support as in claim 10, wherein said attachment end is an attachment point, said attachment location is an attachment intersection, and said stabilizer is a wire.

12. A pair of earring support for a pair of earrings having earring posts, the pair of earring supports comprising:

retainer plates, each retainer plate respectfully having:

a post hole formed therein;

a first face configured for engaging an ear, said first face defining a plane substantially normal to said post hole;

a second face opposite said first face;

a fastening clip at said second face, said fastening clip configured for engaging an earring post passing through said post hole;

a first retainer plate having a first stabilizing support, said first stabilizing support having a first stabilizing support attachment end affixed at a first retainer plate attachment location on said first retainer plate, said first stabilizing support extending, only behind an earlobe when worn by a user, from said first retainer plate attachment location, said first stabilizing support being asymmetrical along all planes spanning from said post hole to said stabilizing support of said first retainer plate;

a second retainer plate having a second stabilizing support, said second stabilizing support having a second stabilizing support attachment end affixed at a second retainer plate attachment location on said second retainer plate, said second stabilizing support extending from said second retainer plate attachment location, said second stabilizing support being asymmetrical along all planes spanning from said post hole to said stabilizing support of said second retainer plate; and said first stabilizing support being mirror symmetrical to said second stabilizing support when considered from a common prospective with respect to said first and second retainer plates, said first stabilizing support and said second stabilizing support, respectively, providing support to backside of the ear when attached to the ear.

13. The pair of earring supports according to claim 12 wherein said first and second stabilizers are wires.

* * * * *